US010071847B2

(12) United States Patent
Mejenborg

(10) Patent No.: US 10,071,847 B2
(45) Date of Patent: Sep. 11, 2018

(54) SMART BIN LOTTERY TICKET DISPENSER WITH CALIBRATED TICKET FEED

(71) Applicant: Scientific Games International, Inc., Newark, DE (US)

(72) Inventor: Sten Hallundbaek Mejenborg, Cumming, GA (US)

(73) Assignee: Scientific Games International, Inc., Newark, DE (US)

( * ) Notice: Subject to any disclaimer, the term of this patent is extended or adjusted under 35 U.S.C. 154(b) by 70 days.

(21) Appl. No.: 15/394,052

(22) Filed: Dec. 29, 2016

(65) Prior Publication Data

US 2018/0186555 A1 Jul. 5, 2018

(51) Int. Cl.

| | |
|---|---|
| ***B65D 83/12*** | (2006.01) |
| ***B65D 83/08*** | (2006.01) |
| ***G07F 17/32*** | (2006.01) |

(52) U.S. Cl.

CPC ..... *B65D 83/0841* (2013.01); *B65D 83/12* (2013.01); *G07F 17/329* (2013.01)

(58) Field of Classification Search

CPC ..... G07F 11/002; G07F 17/329

See application file for complete search history.

(56) References Cited

U.S. PATENT DOCUMENTS

| | | | | |
|---|---|---|---|---|
| 4,106,685 | A | 8/1978 | Strunc et al. | |
| 5,215,383 | A | 6/1993 | Hilton | |
| 5,293,796 | A | 3/1994 | Zober | |
| 9,262,870 | B2 | 2/2016 | Dalas et al. | |
| 9,613,337 | B1 * | 4/2017 | Garrison | G07F 17/329 |
| 9,685,026 | B1 * | 6/2017 | Garrison | G07F 17/329 |
| 2002/0117528 | A1 | 8/2002 | Turek | |
| 2006/0071046 | A1 * | 4/2006 | Roberts | G07F 17/329 225/10 |
| 2009/0152292 | A1 * | 6/2009 | Mirkovic | G07F 17/42 221/258 |
| 2014/0046481 | A1 * | 2/2014 | Siciliano | G07F 11/002 700/236 |
| 2016/0171784 | A1 * | 6/2016 | Chen | G07B 5/02 225/23 |

* cited by examiner

*Primary Examiner* — Timothy R Waggoner

(74) *Attorney, Agent, or Firm* — Dority & Manning, P.A.

(57) ABSTRACT

A lottery ticket dispenser array includes ticket bins having a respective housing for receipt of a supply of interconnected lottery tickets, wherein each ticket in the supply has a calibration mark defined on a longitudinal side edge thereof. An electronic drive mechanism dispenses the lottery tickets through a slot defined in the back side of each bin housing. A calibration field is located relative to the slot such that the lottery tickets pass alongside the calibration field in a travel path of the tickets through the slot. An optical scanner is disposed internal to the housing at a location to read the marks in calibration field. Based on a position of the calibration mark of a leading ticket in the calibration field as detected by the scanner, a control system determines an adjustment to a length of the leading ticket to advance in a subsequent dispense cycle so that a separation line between the leading ticket and an attached trailing ticket is brought by the drive mechanism to a desired position relative to a separation device.

12 Claims, 5 Drawing Sheets

SMART BIN LOTTERY TICKET DISPENSER WITH CALIBRATED TICKET FEED

BACKGROUND

Instant lottery tickets (e.g., "scratch-off" lottery tickets) are sold at many types of retail locations including, stores, such as grocery stores, general merchandise stores, and the like. Various configurations of lottery ticket dispensers have been proposed in the industry for this purpose, including electronic dispensers that automatically dispense a ticket from a bin or compartment upon receipt of an electronic command signal.

The typical scratch-off lottery tickets are delivered to retail establishments in the form of an interconnected strip in a fan-fold or rolled configuration, wherein perforation lines define individual tickets. In this regard, the individual dispensing bins must be equipped with a mechanism for separating the tickets in a reliable and repeatable manner. Various separation devices, such as tear bars, rotary knives, bursting wheels, and so forth are used in lottery ticket dispensers for this purpose. Failure of the final ticket separation process can be costly. For example, if the dispenser does not separate a ticket exactly along the perforation, the ticket may be "unsellable" or information needed for verification can be separated from the ticket and lost.

One cause of improper ticket separation relates to how the ticket feed is detected. In order to advance the interconnected tickets through the drive mechanism by a sufficient amount (length) to ensure that the perforation line is precisely positioned relative to the separation device, the linear ticket feed is often detected by a proximity detector or other sensor (e.g., an edge detector) located within or adjacent to the feeding mechanism. As a ticket tears or is separated from the fanfold, small particles of the ticket material are released and settle within the ticket feeding mechanism and can block the sensor. Thus, such particles can interfere with a proper detection of the ticket by the proximity sensor and result in an erroneous ticket feed.

With certain types of feed mechanisms, inherent characteristics of the drive wheels, clutches, etc., may cause the tickets to skew slightly during the feeding process and lose a desired alignment with the separation mechanism. Loss of alignment with the ticket separation mechanism will generally result in an improper ticket separation.

Another variable that detrimentally impacts the ability to consistently align the perforation lines with the separation device is the manufacturing tolerances of the tickets in general. The length of individual tickets with respect to other tickets in the same fan-fold or rolled stream can vary, for example on the order of a fraction of an inch (e.g., 1/16 inch) inch or so. As a result, even though the separation blade or other type of device may be aligned with the majority of the perforation lines of weakness in a given stack, due to such length, it can easily become misaligned with the perforation lines of other tickets in the same stack.

The present invention provides a reliable and cost-effective improvement to lottery ticket alignment and separation in automated dispensers that addresses at least certain problems noted in the art.

SUMMARY

Objects and advantages of the invention will be set forth in part in the following description, or may be obvious from the description, or may be learned through practice of the invention.

In accordance with aspects of the invention, a lottery ticket dispensing array is provided for dispensing instant or other preprinted lottery tickets at a retail establishment. The type of retail establishment may vary widely within the scope and spirit of the invention. For example, in certain embodiments, the retail establishment may be a convenience store, gas station, pub, or any other establishment that typically sells lottery tickets to the public. The present array has particular usefulness for much larger retail establishments, such as "big-box" retail stores that are part of a national or other geographic chain, wherein the sale of lottery ticket sales has generally not been implemented.

The lottery ticket dispenser array includes a plurality of separate bins, for example an array of 3×4 separate bins, wherein each bin is defined by a housing having a front side that faces a purchaser in operational use of the dispenser array, an opposite back side that faces the retail vendor or clerk. Each bin has a defined first internal space for receipt of a first supply of interconnected lottery tickets (e.g., a roll or fan-folded stack of tickets), wherein a weakened line, such as a perforation line, defines the individual tickets. Each bin may contain a supply of different scratch-off lottery ticket games, or two or more bins may contain a respective supply of tickets for the same game. Each lottery ticket in the supply of tickets includes a calibration mark defined along a longitudinal side edge thereof on either of the front or back surface of the ticket.

Each bin in the array has an electronic drive mechanism that dispenses the lottery tickets therefrom. A slot is defined in the back side of each bin through which the lottery tickets are dispensed from the internal space by the drive mechanism.

Each bin includes a separation device configured adjacent the slot. In certain embodiments, this device is a tear bar or blade against which the tickets are pulled in a dispense cycle to separate the tickets along the perforation line.

In each bin, a calibration field is provided internal to the housing and disposed relative to a travel path of the lottery tickets through the slot such that the longitudinal edge of each lottery ticket having the calibration mark thereon passes alongside the calibration field as the ticket moves in the travel path. This calibration field may include any suitable mark or series marks that define a scale alongside the longitudinal edge of the lottery tickets.

An optical scanner is disposed internal to the housing at a location to read the marks in the calibration field.

A control system is provided, with the optical scanner and the drive mechanism in communication with the control system. Based on a position of the calibration mark of a leading ticket in the calibration field as detected by the scanner, the control system is configured to determine an adjustment to a length of the leading ticket to advance in a subsequent dispense cycle so that a separation line between the leading ticket and an attached trailing ticket is brought by the drive mechanism to a desired position relative to the separation device. Once at this position, the ticket can be pulled against the separation device to separate the leading ticket along the perforation line.

In certain embodiments, the separation device comprises a tear bar (e.g., a blade) disposed internal to the housing adjacent to the slot, with the calibration field disposed upstream of the tear bar relative to the travel path at a location such that the travel path of the lottery tickets is between the scanner and the calibration field.

In some embodiments, the bin may include a first guide plate disposed along the travel path of the lottery tickets upstream of the slot such that the lottery tickets pass adjacent to the guide plate as they are dispensed out the slot. The calibration field may be defined in the guide plate, for example as a single mark, series of marks (e.g., a series of spaced apart lines), design, and so forth, with the scanner at the same side of the first guide plate as the lottery tickets. This embodiment may further include an opposite transparent guide plate spaced from the first guide plate, wherein the lottery tickets pass between the pair of guide plates. For example, the first guide plate may be an upper guide plate and the transparent guide plate may be a lower guide plate, with the scanner disposed below the lower guide plate.

In a particular embodiment, the marks in the calibration field are a series of spaced apart lines aligned longitudinally along and adjacent to the travel path of the lottery tickets. These lines may extend transverse to the longitudinal edge of the tickets and have an increasing or decreasing length in a direction towards the slot. In one embodiment, the lines may include a zero reference line and a plurality of lines on each side of the zero reference line.

In certain embodiments wherein the separation device is downstream of the calibration field in the travel path of the tickets, the control system is further configured to reverse the drive mechanism after the leading ticket has been separated so as to bring the calibration mark of the trailing ticket to a position within the calibration field. With this embodiment, it may be desired to include a sensor configured with the separation device and in communication with the control system, wherein the sensor generates a signal when the leading ticket is separated by the separation device. For example, the separation device may be a tear bar, and the sensor is one of an electrical sensor, mechanical sensor, or electro-mechanical sensor that detects movement or deflection of the tear bar caused by pulling the leading ticket against the tear bar to separate the ticket. The control system reverses the drive mechanism to withdraw the ticket upon receipt of the separation signal from the sensor.

The dispenser may be designed such that the control system is common to all of the bins in the array. In an alternate embodiment, the control system is an individual system, wherein each bin has a dedicated control system. For example, the control system may be implemented by logic circuitry on a control board within each bin.

It should be appreciated that the architecture of the individual bins can vary within the scope of the invention. For example, in one embodiment, the back side of the bin includes a pivotal door that opens to the internal space for loading of the supply of lottery tickets into the bin, wherein the dispensing slot is defined in the pivotal door, and the separation device and scanner are mounted on the door. The calibration field may be defined on a member mounted to the back door at a location such that the lottery tickets pass between the member and the scanner as they are dispensed through the slot.

It should be appreciated that the present invention also encompasses a stand-alone ticket dispensing bin as described herein.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Figure 1:
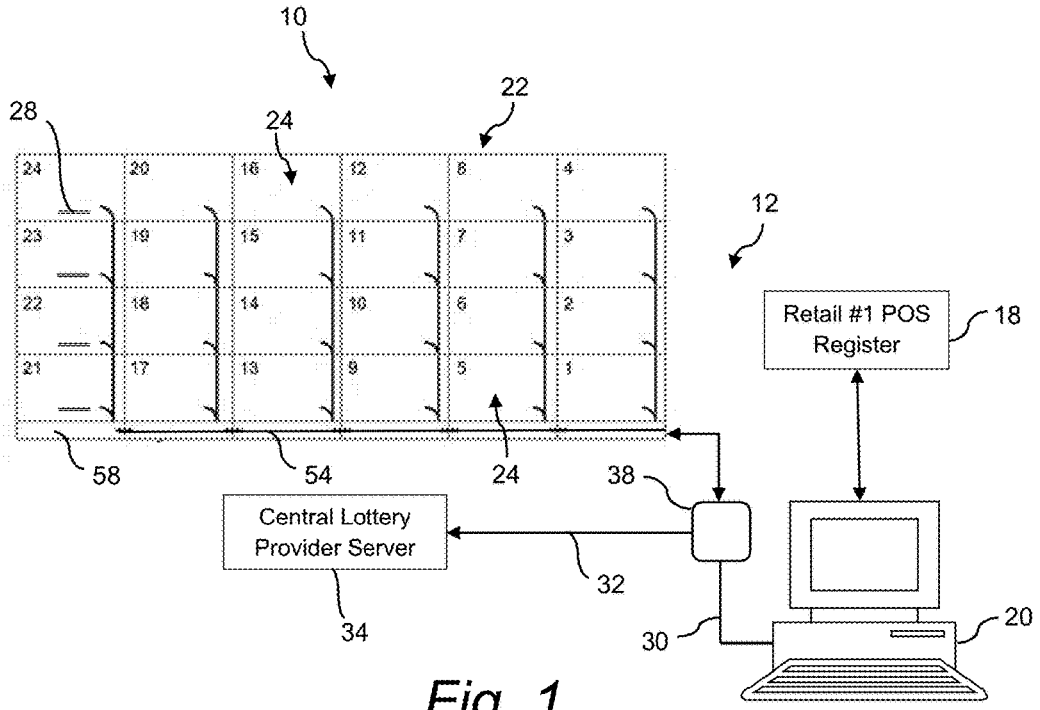
FIG. 1 is a block diagram of a lottery ticket dispenser in accordance with aspects of the present invention.

FIG. 1 depicts an embodiment of a system 10 and related methodology for dispensing lottery tickets 14 at a retail establishment 12. As mentioned above, the type of retail establishment 12 may vary widely within the scope and spirit of the invention. A retail establishment or location 12, such as a retail store, convenience store, pub, restaurant, or the like, is generally authorized by a lottery jurisdiction to carry out lottery activities, such as the sale of instant scratch-off tickets or terminal printed draw tickets for games such as Powerball™. The lottery jurisdiction may be a state lottery authority, such as the Pennsylvania Lottery, or any other governmental jurisdictional authority. A separate game provider may be partnered with the lottery jurisdiction to provide certain control, implementation, and logistical functions of the game. It should be appreciated that the type of retail establishment 12 or lottery jurisdiction entities are not limiting factors of the invention. Although not limited to such, the present system 10 has particular usefulness for larger retail establishments, such as "big-box" retail stores that are part of a national or other geographic chain.

The retail establishment 12 includes one or more retail point-of-sale (POS) registers 18 wherein patrons of the establishment 12 purchase goods. Typically, a scanner is associated with the POS register 18 to scan a UPC code on the products, with the UPC code linked to a purchase price and identification of the products, as is well-known in the art.

Figure 3:
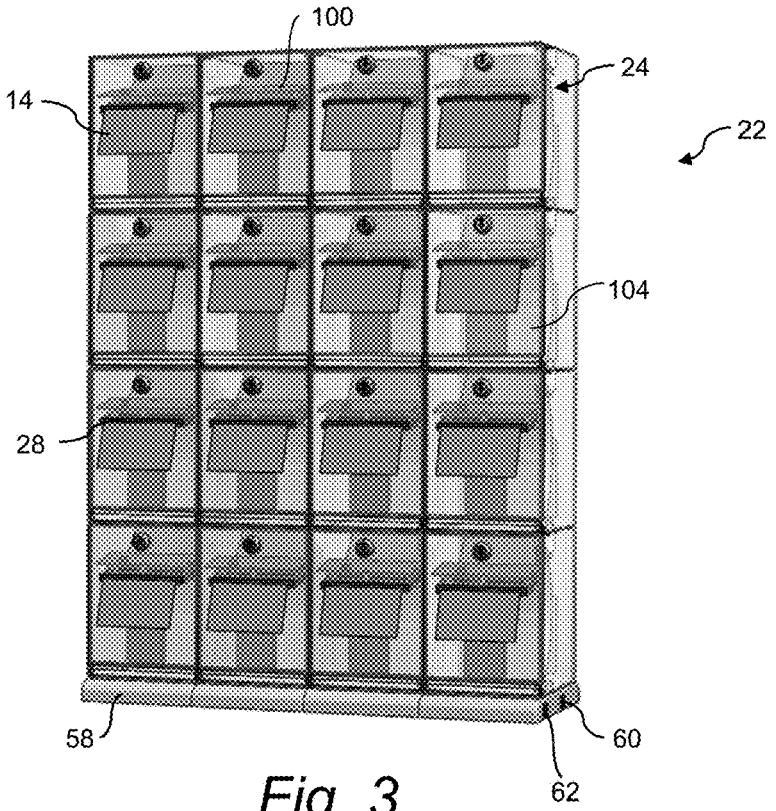
FIG. 3 is a back perspective view of an embodiment of a lottery ticket dispenser.

In the embodiment of FIG. 1, a lottery ticket terminal 20 is configured in wired or wireless communication with the retail POS register 18 to accept a request for purchase of a particular lottery ticket 14 (FIG. 3) selected from a plurality of different lottery tickets made available to patrons for purchase. This request may be input directly to the terminal 20 or come via the POS register 18. The lottery tickets 14 may be, for example, conventional instant scratch-off lottery tickets. Various types of lottery ticket terminals are known in the art and suitable for configuration with a system 10 in accordance with the invention. For example, Scientific Games Corporation having a principal place of business in Alpharetta, Ga., USA, offers Flair™ and Wave™ lottery ticket terminals that may be readily configured by those skilled in the art for a system as described herein.

A patron's request for a particular scratch-off lottery ticket may be inputted into the lottery ticket terminal 20 by a retail clerk or other employee of the retail establishment 12 by various means. For example, the terminal 20 may be configured with a scanner, wherein the clerk scans a "master" card having a code corresponding to the particular lottery ticket 14 requested by the patron. Thus, a master card or master code would be provided for each type of lottery ticket 14 offered by the establishment 12. In another embodiment, the terminal 20 may be configured with a touch-screen, keyboard, or other data input device, wherein the clerk enters or identifies the ticket 14 requested by the patron.

Still referring to the embodiment of FIG. 1, a "smart" lottery ticket dispenser array 22 is in wired or wireless communication with the terminal 20. This dispenser array includes one or a plurality of individual lottery ticket bins 24, with each bin 24 typically containing a different respective lottery ticket game. For example, one bin 24 may contain "Lucky 7" themed scratch-off lottery tickets 14, while an adjacent bin 24 may contain "Gold Rush" themed scratch-off lottery tickets 14, and so forth.

Each lottery ticket 14 in the different bins includes a machine readable code 101 (FIG. 8A) printed on a front or back side thereof, such as an alpha-numeric code, bar code, QR code, or the like. The type of code 101 may vary depending on the desired information content of the code, space on the ticket 14, and so forth. The use of such codes 101 on lottery tickets 14 for various functions related to inventory, identification, verification, and security are well-known. In accordance with aspects of the invention, the lottery tickets in each bin 24 are generally loaded as a fan-folded or roll of sequentially numbered tickets, wherein the machine readable code on each lottery ticket 14 contains this number (as well as any manner of additional ticket information), for example in the form of a serial number embedded in the code.

Referring to the figures in general, each bin 24 in the dispenser array 22 includes an electronic drive mechanism 26 that, when activated, dispenses one or more lottery tickets 14 from the bin 24 (depending on the number of tickets requested by the patron). This drive mechanism 26 may include a motor that drives a friction roll, wherein the tickets 14 are engaged between the friction roll and an idler roll such that driven rotation of the friction roll causes the tickets 14 to be advanced through a dispensing slot 28 in a wall of the individual bin 24.

For each dispense cycle of a lottery ticket, a predefined length of ticket is advanced by the drive mechanism 26. For example, if the lottery tickets are six-inch long tickets, the drive mechanism 26 advances the interconnected tickets in six-inch increments. For this function, the friction or idler roll may include an electrical or mechanical encoder that indirectly measures the length of a ticket passing between the rolls as a function or rotations of the roll. In another embodiment, a timing circuit may control the length of ticket dispensed as a function of run time of the motor. It should be appreciated that the drive mechanism 26 may be variously configured to perform the functions of dispensing the requisite number and length of tickets 14 from the individual respective bin 24 within the scope and spirit of the invention.

In the illustrated embodiments, each bin 24 also includes an optical scanner 40 disposed so as to read a calibration field 109 (discussed in greater detail below). This same scanner 40 may also serve to read the code 101 discussed above) on the lottery tickets 14 as they are dispensed from the bin 24. The scanner 40 may be any conventional optical scanner or reader, such as a point scanner, linear scanner, laser scanner, LED image scanner, and so forth. The tickets 14 are loaded into the bins 24 such that the code printed on each ticket passes within the detection field of the scanner 40. An integral (or separate) reader is typically configured with the scanner 40 to decode the scanner signal.

The architecture of each bin 24 and the array 22 in general can vary within the scope of the invention. Referring to the depicted embodiments of FIGS. 1 through 7, the dispenser array 22 includes a bottom row of bins 24 having interconnected base structures 58. For example, each base structure 58 may include a male power plug and male data plug along one side, and a female power port 60 and female data port 62 along the opposite side. The plugs and ports of adjacent base structures 58 interconnect to essentially define a data bus 54 (FIGS. 1 and 2) running the length of the base structures 58. An exposed power port 60 and data port 62 at one of the ends of the interconnected base structures is available for connection with a power cord and a data cord from the system control system 38 or lottery terminal 20.

Figure 5:
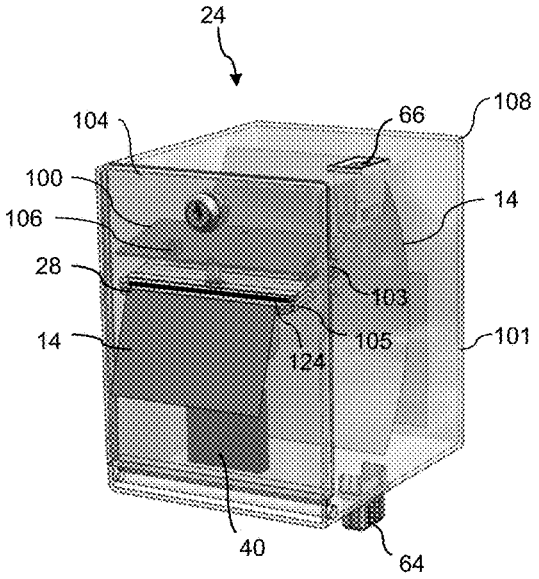
FIG. 5 is a front perspective view of a lottery ticket bin in accordance with the invention.
Figure 6:
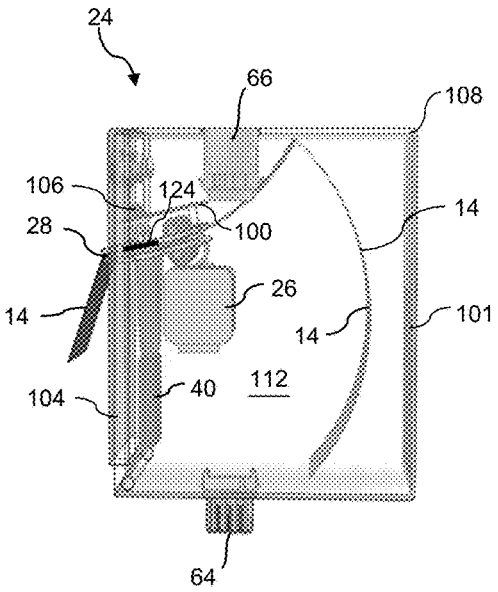
FIG. 6 is a side view of the bin embodiment of FIG. 5.
Figure 7:
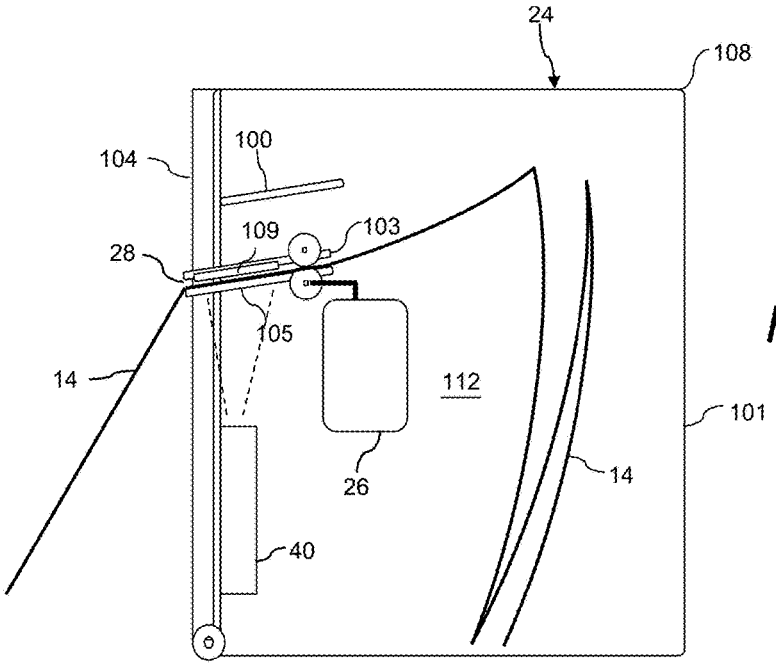
FIG. 7 is another side view of a bin in accordance with aspects of the invention.

Referring to FIGS. 5 and 6 in particular, each of the individual bins 24 includes a multi-sided housing 108 defining an internal space 112 in which the stack or roll of lottery tickets 14 is stored. In the depicted embodiments, the housing 108 is a box-like member having top and bottom walls, side walls, a front wall 101, and a pivotal back wall or door 104. The back wall 104 swings open to provide access into the housing 108 for loading the ticket stack. The dispensing slot 28 may be defined in this wall 104.

Figure 4:
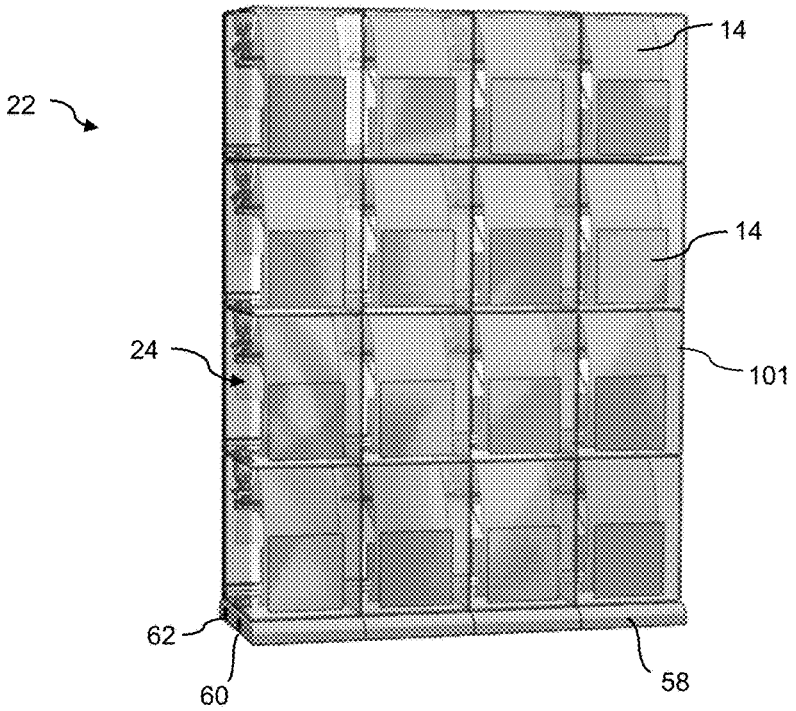
FIG. 4 is a front perspective view of the lottery ticket dispenser of FIG. 3.

As shown in FIG. 4, each bin 24 may include a sample ticket 14 or other identifying insert attached to a front face of the bin 24 that faces the patrons so that the patron is aware of the exact tickets available for purchase. Each bin 24 includes a male power/data connector 64 on the top or bottom surface, and a corresponding female power/data connector 66 on the opposite surface, as seen in FIGS. 5 and 6. With this configuration, a plurality of the bins 24 can be vertically stacked and interconnected, as depicted in the various figures.

Referring to FIGS. 5 through 8D in general, each bin 24 in the array 22 includes a separation device 124 configured within the housing 18 adjacent the slot 28. In certain embodiments, this device 124 is a tear bar or blade against which the tickets 14 are pulled in a dispense cycle to separate the tickets 14 long a weakened line 122, such as a perforation line, between adjacent tickets 14. The separation device 124 may also be mounted to the back wall 104.

In each bin 24, a calibration field 109 is provided internal to the housing 108 relative to the slot 28 such that the lottery tickets 14 pass alongside the calibration field 109 in the travel path of the lottery tickets 14 through the slot 28. In particular, as depicted in FIGS. 8A through 8D, a longitudinal side edge 115 of each lottery ticket 14 passes alongside the calibration field 109. A calibration mark 113 is printed at a position along the longitudinal side edge 115. This mark 113 may be any manner of design, size, color, and so forth, and serves to indicate a relative position of the respective ticket 14 with respect to the calibration field 109. Accordingly, the location of the calibration mark 113 along the side edge 115 is selected such that when a perforation line 122 between two adjacent tickets is at or near the separation device 124, the calibration mark 113 on the trailing ticket is within the calibration field.

The calibration field 109 includes any suitable mark or series marks 111 that are aligned longitudinally alongside the travel path of the ticket 14 through the dispensing slot and indicate a defined adjustment distance of a forward edge 126 of the lottery ticket from the separation device 124 as a function of location of the calibration mark 113 along the series of marks 111. In the depicted embodiment, the marks 111 are a series of lines oriented transverse to the side edge 115 of the tickets and spaced apart in a longitudinal direction of the travel path of the tickets. The mark or marks 11 can, for example, define a scale or gradient that includes a zero reference-mark 117 (indicating that no adjustment is necessary in the subsequent dispense cycle) with a series of additional marks on each side of the zero-reference mark 117, wherein each additional mark indicates a defined distance to be added to or subtracted from the drive length of the subsequent dispense cycle.

The optical scanner 40 is disposed internal to the housing at a location to scan the marks 111 in calibration field 109, wherein the position of the calibration mark 113 on the lottery tickets 14 along the marks 111 within the field 109 is detected by the scanner 40 and used by a control system 38 to determine a precise location of the forward edge 126 relative to the separation device 124. The field 109 is designed so that any location of the calibration mark 113 within the field indicates a precise distance of the edge 126 from the separation device 124. Defined distances are predetermined for different marks 111, or portions of the same mark in the calibration field 109, and the distance of the forward edge 126 from the separation device can be extrapolated if the calibration mark 113 does not lie exactly adjacent one of the marks 111.

The optical scanner 40 and the drive mechanism 26 are in communication with the control system 38. Based on the position of calibration mark 113 alongside the calibration field 109 detected by the scanner and a stored predefined length of the lottery tickets 14, the control system 38 determines an adjustment to the stored length amount of the leading ticket 120 to advance in a subsequent dispense cycle so that the separation line 122 between the leading ticket 120 and an attached trailing ticket 130 is brought by the drive mechanism 26 to a desired position relative to the separation device 124. Once at this position, the leading ticket 120 can be pulled against the separation device 124 to separate the leading ticket 120 along the perforation line 122.

In embodiments wherein the separation device 124 comprises a tear bar (e.g., a blade) disposed internal to the housing 108 adjacent to the slot 28, the calibration field 109 may be located upstream of (relative to the travel path of the tickets 14) and to the side of the tear bar 124 such that the travel path of the lottery tickets is between the scanner 40 and the calibration field 109.

As indicated in the illustrated embodiments, the bin 24 may include a first guide plate 103 mounted on the pivotal wall 104 and disposed along the travel path of the lottery tickets upstream of the slot 28 such that the lottery tickets pass adjacent to the guide plate 103 as they are dispensed out the slot 28, wherein the scanner 40 is located at the same side of the guide plate 103 as the lottery tickets. The calibration field 109 may be provided on or defined in the guide plate 103, for example printed, engraved, or etched in the plate 103 as a single mark, series of marks 111 (e.g., a series of spaced apart lines), design, and so forth. In the illustrated embodiment, the guide plate 103 is an upper guide plate. This embodiment may further include a transparent lower guide plate 105 spaced from the upper guide plate 103, wherein the lottery tickets pass between the upper 103 and lower 105 guide plates. The lower plate 105 is sufficiently transparent so that the scanner 40 can "see" through the lower plate 105.

Figure 8A:
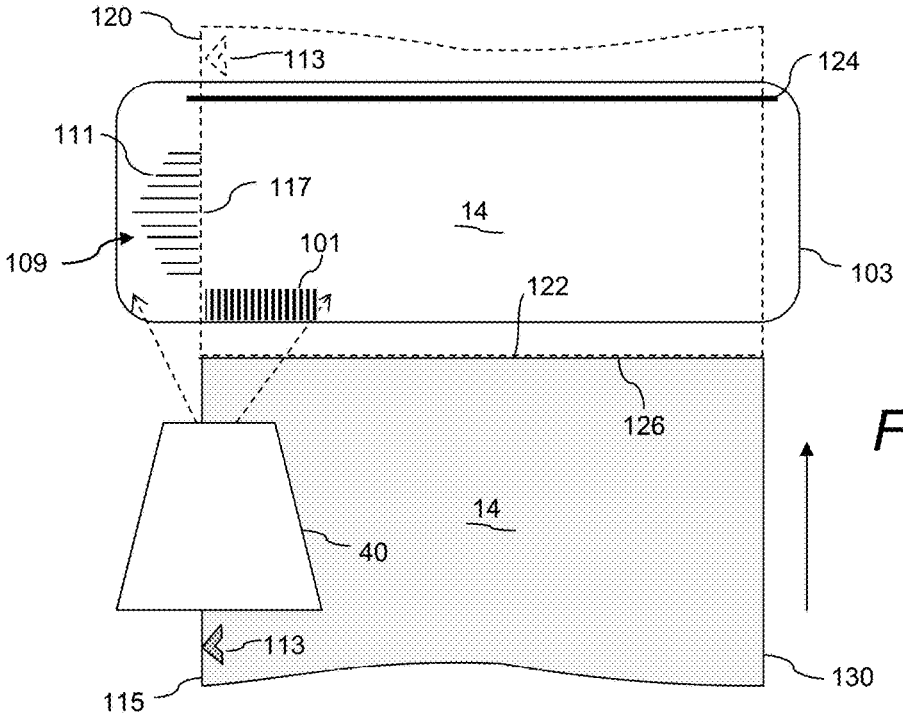
FIGS. 8A through 8D are sequential diagram views depicting movement of lottery tickets relative to a calibration field in accordance with aspects of the invention.

In FIG. 8A, a leading lottery ticket 120 (dashed lines) is depicted as moving under the upper guide plate 103, with the longitudinal side edge 115 moving alongside of the calibration field 109. The leading ticket 120 is attached to the trailing ticket 130 via a perforation or other type of weakened line 122.

Figure 8B:
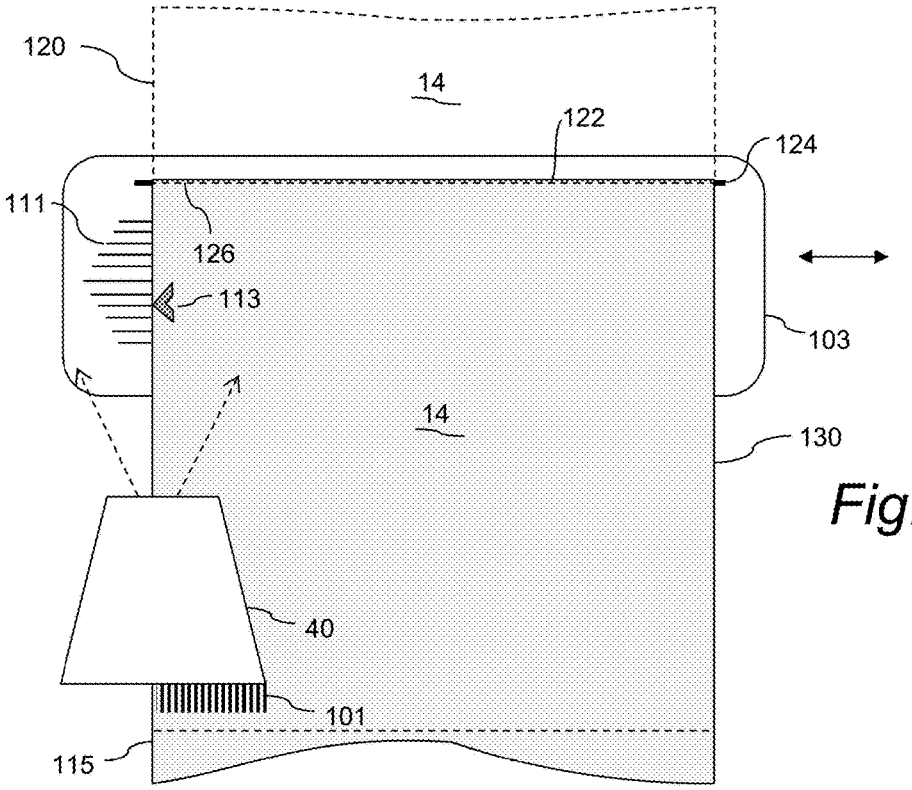

FIG. 8B depicts the leading ticket 120 advanced to a stopped position determined by the control system 38 (as discussed above) such that the perforation line 122 between the leading ticket 120 and trailing ticket 130 is at or sufficiently near the tear bar 124. At this position, the leading ticket 120 can be pulled against the tear bar 124 and separated from the trailing ticket 130.

Figure 8C:
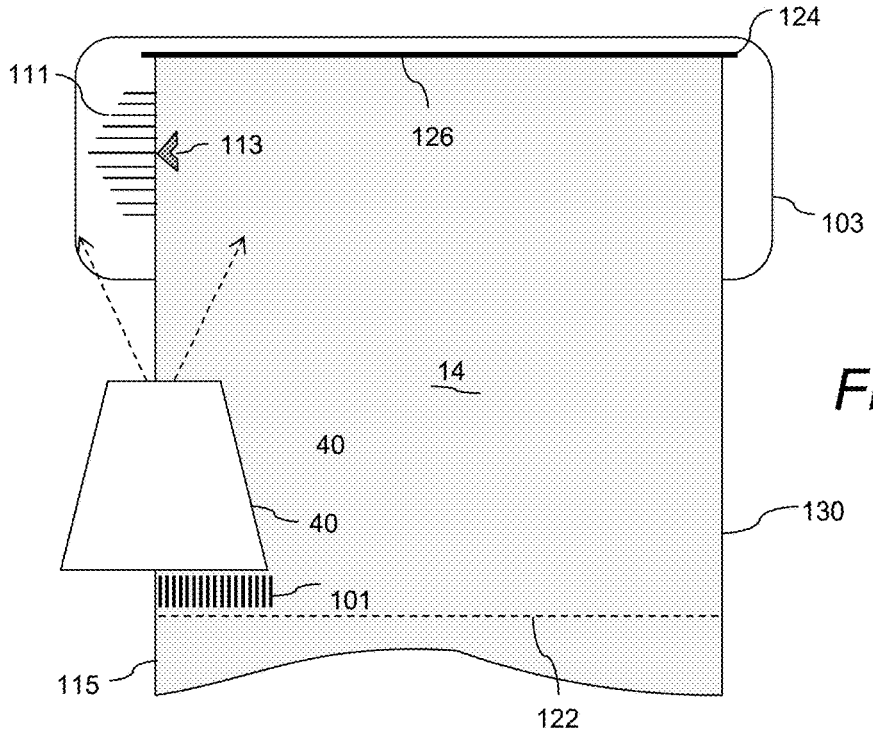

A particular benefit of the present system is that, after separation of the leading ticket 120 from the trailing ticket 130 as depicted in FIG. 8C, it is not necessary to reverse the drive mechanism 26 to withdraw the leading edge 126 of the trailing ticket to a "starting position" within the dispenser bin 24 from which the predetermined drive length of each ticket 14 is set so long as the calibration mark 113 on the trailing ticket 130 lies within the calibration field 109

Figure 8D:
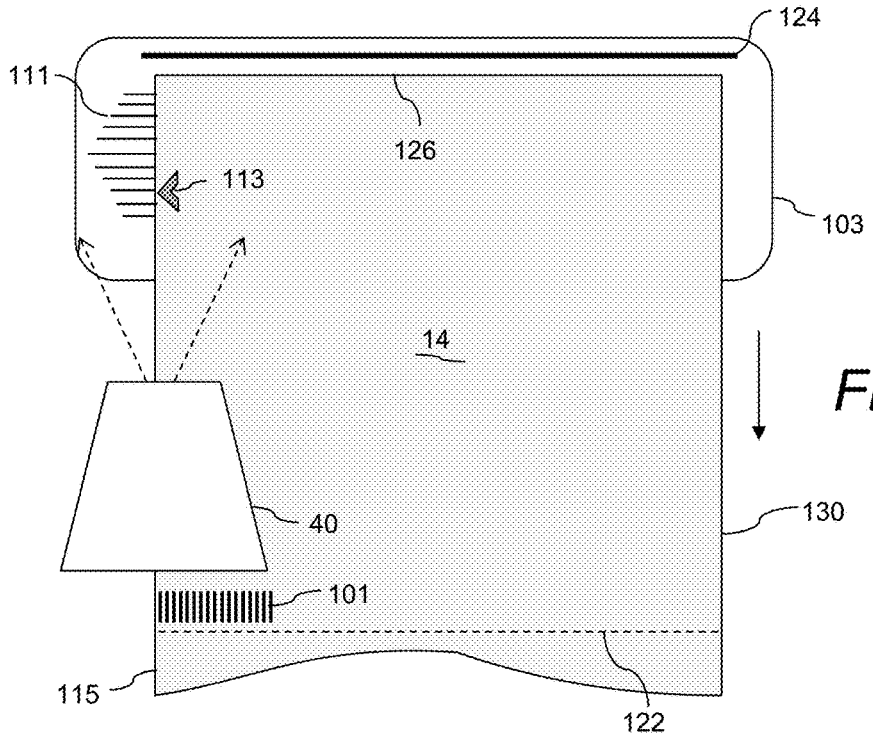

Although not necessary for the reasons just discussed, in certain embodiments, it may be desired to withdrawn the trailing ticket 130 back into the array 24 a predefined amount after each ticket dispense cycle, for example so that the leading edge 126 of the trailing ticket 130 does not extend out of the slot 28 (or is not visible in the slot 28). Thus, the control system 38 may be further configured to reverse the drive mechanism 26 after the leading ticket 120 has been separated so as to withdraw the forward edge 126 of the trailing ticket 130 (which is now the new leading ticket 120) to a position within the bin 24, as depicted in FIG. 8D Reversal of the ticket direction is then stopped such that the forward edge 126 lies within the bin 24 and the calibration mark 113 on the trailing ticket 130 lies within the calibration field 109. Based on the position of the calibration mark 113 relative to the calibration field 109, the control system 38 then computes the adjustment to the predefined length amount the ticket 130 that must be advanced by the drive mechanism 26 in the next dispense cycle, as explained above. As discussed, the drive mechanism may include an encoder or timing circuit for this purpose.

With the embodiment depicted by FIGS. 8A through 8D, it may be desired to include a sensor 106 configured with the separation device 124 and in communication with the control system 38, wherein the sensor 106 generates a signal when the leading ticket 120 is separated by the separation device 124. For example, if the separation device 124 is a tear bar, the sensor 106 may be one of an electrical sensor, mechanical sensor, or electro-mechanical sensor that detects movement or deflection of the tear bar caused by pulling the leading ticket 120 against the tear bar to separate the ticket. The control system 38 reverses the drive mechanism 26 to withdraw the ticket upon receipt of the separation signal from the sensor 106.

The dispenser 22 may be designed such that the control system 38 is common to all of the bins 24 in the array. In an alternate embodiment, the control system 38 is an individual system, wherein each bin 24 has a dedicated control system 38. For example, the control system may be implemented by logic circuitry on the control board 100 within each bin 24.

Figure 2:
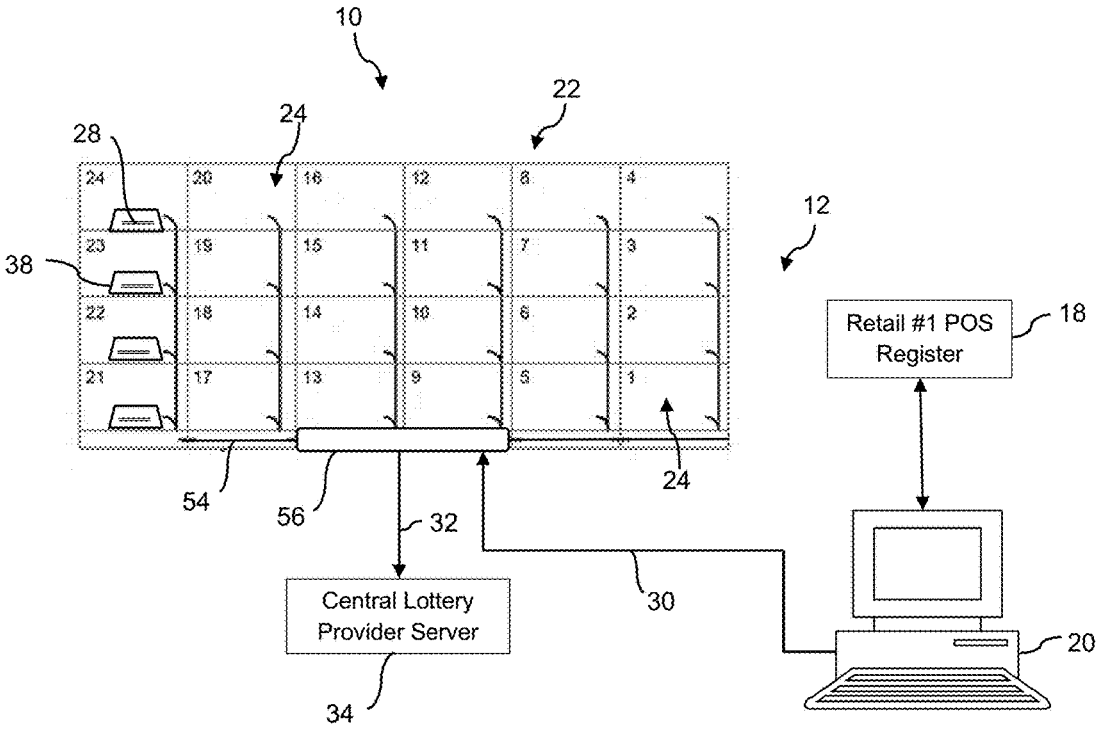
FIG. 2 is a block diagram of another embodiment of a lottery ticket dispenser in accordance with aspects of the present invention.

Any manner of control or power components can be mounted on the board 100 for operation of the individual bins 24 as described herein. FIG. 2 depicts individual control systems 38 for each bin 24 in direct communication with the terminal 20 via a signal router 56 integrated with the dispenser array 22. This router 56 routes the purchase signal 30 from the lottery ticket terminal 20 to the correct bin 24.

Referring to the system 10 in FIGS. 1 and 2, the lottery ticket terminal 20 transmits a purchase signal 30 for dispensing a particular lottery ticket 14 that is routed to the respective bin 24 within the dispenser array 22 containing the requested lottery ticket. This purchase signal 30 may be sent to an individual control system 38 associated with the bin 24 (FIG. 2), or to a common control system 38 associated with all of the bins 24 (FIG. 1), to activate the drive mechanism 26 and dispense the requisite number of lottery tickets 14 from the bin 24. Signals from the tear bar sensor 106 are received by the control system 38 (individual system or common system).

In an alternate embodiment, the purchase signal 30 is generated by the POS register 18 and transmitted to the control system 38 after the POS register 18 receives a purchase code from the lottery ticket terminal 20 corresponding to the particular ticket requested by the patron.

The system 10 may include a central lottery server 34 that is common to a number of different retail establishments 12. As described above, as the tickets 14 are dispensed from the bin 24, the scanner 40 reads the code printed on each ticket or, alternatively, the first and last codes printed on sequentially dispensed tickets, and the tear bar sensor 106 detects a ticket separation cycle. A signal 32 form the control system 38 containing the scanned code and tear bar sensor data may be routed to the central lottery server 34 for each lottery ticket dispensed from the dispenser array 22 to enable certain actions relevant to the sale, dispensing, verification, accounting of the individual tickets 14. For example, the central lottery server 34 may include a database of all tickets delivered to the respective retail establishments 12, and the near instantaneous identification of dispensed/sold lottery tickets 14 to the server 34 enables various desired functionalities. For example, the individual lottery tickets 14 may remain "inactive" in the lottery provider's system (and thus unable to be redeemed) until individually activated by the central lottery server 34 as they are dispensed and sold. Thus, fraudulently obtained tickets (e.g., stolen or otherwise illegally obtained) cannot be redeemed. This is contrary to a conventional practice of activating entire books ("packs") of tickets upon delivery to a retail establishment 12.

The present system also 10 allows for enhanced accountability of lottery tickets 14 sold at a particular retail establishment 12 by logging each ticket as it is sold and dispensed. The number of tickets 14 sold during a work shift (or other time period) is easily determined by generating a report by the central server 34 of the tickets sold at any of the retail establishments during any defined time period. The number of tickets 14 sold at any of the retail establishments 12 can be readily reconciled with tickets delivered to the establishment. Likewise, the number of tickets 14 dispensed during a defined time can be readily and electronically reconciled with reported purchase transactions from the respective establishment 12, with discrepancies being immediately identified for further investigation.

Another particular advantage of the system 10 and associated method is that billing practices between the retail establishments 12 and lottery authority, the lottery service provider, or ticket manufacturer can be based on real-time sales of the lottery tickets 14. For example, the retail establishments 12 can be invoiced on a periodic basis (e.g., daily or weekly) for the actual number of tickets sold (dispensed) at each respective establishment based on the signals 32 routed to the central lottery server 34 instead of upon delivery, or other payment methodology typically in use today. These include but are not limited to consignment for a predetermined time period, or estimate of sales based on the number of winning tickets cashed from a pack of tickets being sold.

It should be appreciated that the term "server" is used herein to encompass any configuration of computer hardware and software that is maintained by a lottery authority or game provider to carry out the functionalities of the present system 10 and associated method, as well as any manner of additional lottery functions known to those skilled in the art.

The server 34 may include an integrated server, or any manner of periphery server or other hardware structure. The central lottery server 34 is typically remote from the retail establishments 12, and is in communication with the establishments 12 via a suitable secure communication network, which may include any manner of wide area network, wireless internet, or cloud computing. The server 34 may be a single networked computer, or a series of interconnected computers having access to the communications network via a gateway or other known networking system. Generally, the server 34 is configured to communicate with, manage, execute and control individual lottery terminal units 20 within the lottery jurisdiction. The server 34 may be a "front end" server provided by the lottery game provider that is interfaced with the existing draw/instant game system infrastructure one or more separate lottery authorities. The server 34 may include a memory for storing gaming procedures and routines, a microprocessor (MP) for executing the stored programs, a random access memory (RAM) and an input/output (I/O) bus. These devices may be multiplexed together via a common bus, or may each be directly connected via dedicated communications lines, depending on the needs of the system 10.

The server 34 may be directly or indirectly connected through an I/O bus to any manner of peripheral devices such as storage devices, wireless adaptors, printers, and the like. In addition, a database (DB) may be communicatively connected to the server 34 and provide a data repository for the storage and correlation of information gathered from the individual dispenser arrays 22, such as the identity of each lottery ticket 14 dispensed from the array, the time of the dispense sequence, confirmation of ticket activation, and so forth.

It should be appreciated that embodiments of the methods and systems 10 disclosed herein may be executed by one or more suitable networked lottery gaming components and establishment components (e.g., POS register 18, back office server, and so forth) within a plurality of the establishments 12, as well as the remote central server 34. Such gaming systems and computing devices may access one or more computer-readable media that embody computer-readable instructions which, when executed by at least one computer, cause the computer(s) to implement one or more embodiments of the methods of the present subject matter. Additionally or alternatively, the computing device(s) may comprise circuitry that renders the device(s) operative to implement one or more of the methods of the present subject matter. Furthermore, components of the presently-disclosed technology may be implemented using one or more computer-readable media.

As mentioned above, aspects of the present system 10 and methods rely on the transmission of data over one or more communications networks. It should be appreciated that network communications can comprise sending and/or receiving information over one or more networks of various forms. For example, a network can comprise a dial-in, public switched telephone network (PSTN), a local area network (LAN), wide area network (WAN), the Internet, an intranet or other type of network. A network may comprise any number and/or combination of hard-wired, wireless, or other communication links.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A lottery ticket dispenser array, comprising:

a plurality of separate bins, each bin defined by a housing having a front side that faces a purchaser in operational use of the dispenser bin, an opposite back side, and an internal space for receipt of a supply of interconnected lottery tickets, wherein each lottery ticket in the interconnected supply has a calibration mark defined on a longitudinal side edge thereof;

each bin having an electronic drive mechanism that dispenses the lottery tickets therefrom;

a slot defined in the back side of each bin through which the lottery tickets are dispensed from the internal space;

a separation device configured adjacent the slot;

a calibration field internal to the housing and disposed relative to a travel path of the lottery tickets through the slot such that the longitudinal side edge of each lottery ticket passes alongside the calibration filed, the calibration field defined by one or more visible marks;

an optical scanner disposed internal to the housing at a location to read the marks in the calibration field;

a control system, the optical scanner and the drive mechanism in communication with the control system; and wherein, based on a position of the calibration mark of a leading ticket in the calibration field as detected by the scanner, the control system is configured to determine an adjustment to a length of the leading ticket to advance in a subsequent dispense cycle so that a separation line between the leading ticket and an attached trailing ticket is brought by the drive mechanism to a desired position relative to the separation device.

2. The lottery ticket dispenser as in claim 1, wherein the separation device comprises a tear bar disposed internal to the housing adjacent to the slot, the calibration field disposed upstream of the tear bar relative to the travel path at a location such that the travel path of the lottery tickets is between the scanner and the calibration field.

3. The lottery ticket dispenser as in claim 2, further comprising a first guide plate disposed along the travel path of the lottery tickets such that the lottery tickets pass adjacent to the first guide plate, the calibration field defined in the first guide plate, and the scanner disposed at a same side of the first guide plate as the lottery tickets.

4. The lottery ticket dispenser as in claim 3, wherein the first guide plate is an upper guide plate, and further comprising a transparent lower guide plate spaced from the upper guide plate, the lottery tickets passing between the upper and lower guide plates.

5. The lottery ticket dispenser as in claim 1, wherein the one or more marks in the calibration field comprises a series of spaced apart lines aligned longitudinally along and adjacent to the travel path of the lottery tickets.

6. The lottery ticket dispenser as in claim 5, wherein the lines have a zero-reference line and a plurality of lines on each side of the zero reference line.

7. The lottery ticket dispenser as in claim 1, wherein the control system is configured to reverse the drive mechanism after the leading ticket has been separated so as to bring the calibration mark of the trailing ticket to a position within the calibration field.

8. The lottery ticket dispenser as in claim 7, further comprising a sensor configured with the separation device and in communication with the control system, the sensor generating a signal when the leading ticket is separated by the separation device.

9. The lottery ticket dispenser as in claim 8, wherein the separation device is a tear bar, and the sensor comprises one of an electrical sensor, mechanical sensor, or electro-mechanical sensor that detects movement of the tear bar caused by pulling the leading ticket against the tear bar to separate the leading ticket.

10. The lottery ticket dispenser as in claim 1, wherein the control system is common to all of the bins in the array.

11. The lottery ticket dispenser as in claim 1, wherein the control system is an individual control system for each bin.

12. The lottery ticket dispenser as in claim 1, wherein the back side of each bin comprises a pivotal door that opens to the internal space for loading of the supply of lottery tickets into the bin, the slot defined in the pivotal door, the separation device mounted on the pivotal door, the scanner mounted on the back door, and the calibration field defined on a member mounted to the back door at a location such that the lottery tickets pass between the member and the scanner as they are dispensed through the slot.

* * * * *